United States Patent [19]

Ragland, Jr.

[11] Patent Number: 4,599,533

[45] Date of Patent: Jul. 8, 1986

[54] COLOR PICTURE TUBE HAVING SHADOW MASK FRAME WITH TRUNCATED CORNERS

[75] Inventor: Frank R. Ragland, Jr., Lancaster, Pa.

[73] Assignee: RCA Corporation, Princeton, N.J.

[21] Appl. No.: 610,483

[22] Filed: May 15, 1984

[51] Int. Cl.[4] ..... H01J 29/80

[52] U.S. Cl. ..... 313/407; 313/402; 313/403; 313/404

[58] Field of Search ..... 313/402, 403, 407, 404

[56] References Cited

U.S. PATENT DOCUMENTS

| | | | |
|---|---|---|---|
| 3,368,098 | 2/1968 | Demmy | 313/407 |
| 3,585,431 | 6/1971 | Long | 313/85 |
| 3,585,431 | 6/1971 | Long | 313/85 |
| 3,862,448 | 1/1975 | Ishizuka et al. | 313/402 |
| 4,056,755 | 11/1977 | Sohn | 313/402 |
| 4,099,086 | 7/1978 | Röder et al. | 313/407 |
| 4,317,064 | 2/1982 | Dougherty | 313/406 |
| 4,387,321 | 6/1983 | Gijrath et al. | 313/406 |
| 4,437,036 | 3/1984 | Ragland, Jr. | 313/402 |

FOREIGN PATENT DOCUMENTS

| | | | |
|---|---|---|---|
| 0129876 | 10/1979 | Japan | 313/407 |

*Primary Examiner*—Davis L. Willis
*Assistant Examiner*—William L. Oen
*Attorney, Agent, or Firm*—Eugene M. Whitacre; Dennis H. Irlbeck

[57] ABSTRACT

An improvement is made in a color picture tube that includes an evacuated envelope having a rectangualr faceplate panel with major and minor axes, wherein a central longitudinal axis of the tube passes through the center of the faceplate perpendicular to the major and minor axes. The faceplate panel includes a shadow mask welded at various points including its corners to a peripheral frame mounted therein. The frame is L-shaped having a first flange approximately paralleling the central longitudinal axis and a second flange extending toward and approximately perpendicular to the central longitudinal axis. The tube improvement comprises the frame having truncated corners wherein the first flange at each of the frame corners is straight, flat and acutely angled with respect to both the major axis and the minor axis. A peripheral portion of the shadow mask conforms to the shape of the first flange and is telescoped thereon. The corner welds attaching the shadow mask to the frame are located approximately at the centers of the straight and flat portions of the truncated corners.

3 Claims, 8 Drawing Figures

COLOR PICTURE TUBE HAVING SHADOW MASK FRAME WITH TRUNCATED CORNERS

BACKGROUND OF THE INVENTION

This invention relates to color picture tubes of the type having a shadow mask attached to a peripheral frame which is suspended in relation to a cathodoluminescent screen, and particularly to a novel mask-frame assembly shape which aids in reducing shadow mask doming during tube operation.

In these color picture tubes, the accuracy with which the electron beams, emitted from an electron gun, strike individual elemental cathodoluminescent screen areas depends, to a great degree, upon the accuracy with which the shadow mask apertures are aligned with the elemental screen areas during operation of the tube. During initial tube operation, the shadow mask is heated by the impingement of the electron beams thereon at a much faster rate than is the heavier peripheral frame. Because of this heating differential, the shadow mask expands at a greater rate than the frame. Since the shadow mask is peripherally welded to the frame, this more rapid expansion of the shadow mask causes the frame to resist the mask expansion, thereby resulting in mask doming. Such mask doming causes the electron beams, passing therethrough, to misregister with their associated elemental screen areas, thereby resulting in an undesirable shift in color on the screen.

Several prior patents have addressed this doming problem. U.S. Pat. No. 3,368,098, issued to Demmy on Feb. 6, 1968, teaches the use of a limited number of mask-to-frame welds to eliminate or reduce a negative distortion of a shadow mask during the warmup period of tube operation. U.S. Pat. No. 3,585,431, issued to Long on June 15, 1971, discloses the formation of a flutted mask skirt, wherein the mask is welded to a frame such as to permit radial movement of the mask away from a peripheral surface of the frame during tube warmup. U.S. Pat. No. 3,862,448, issued to Ishizuka et al. on Jan. 21, 1975, teaches the use of a reduced mass cushion zone at a mask skirt to minimize the stresses in the mask caused by heating the mask. U.S. Pat. No. 4,099,086, issued to Roder et al. on July 4, 1978, discloses a mask skirt having cutouts near its corners to define corner tongues. The tongues are curved and are welded to a mask frame. In one embodiment, the tongues have a further recess or a corrugation to provide a hinge effect. Each of these prior patents is hereby incorporated by reference for purpose of including the disclosures contained therein.

Although all of these prior patents solved particular problems associated with the tube types in which they were applied, more recent tube designs necessitate the development of other solutions to the problems caused by mask expansion. One of these more recent tube designs utilizes a flatter, more truely rectangular, shadow mask.

SUMMARY OF THE INVENTION

An improvement is made in a color picture tube that includes an evacuated envelope having a rectangular faceplate panel with major and minor axes, wherein a central longitudinal axis of the tube passes through the center of the faceplate perpendicular to the major and minor axes. The faceplate panel includes a shadow mask welded at various points including its corners to a peripheral frame mounted therein. The frame includes a flange approximately paralleling the central longitudinal axis. The shadow mask includes a peripheral skirt approximately paralleling the central longitudinal axis. The tube improvement comprises the shadow mask having truncated corners wherein the skirt portions at the corners are straight, flat and acutely angled with respect to both major and minor axes and are welded to the frame at approximately the centers of the straight and flat skirt portions. In a preferred embodiment, the frame has truncated corners wherein the flange at each of the frame corners is straight, flat and acutely angled with respect to both the major axis and the minor axis. A peripheral portion of the shadow mask conforms to the shape of the flange and is telescoped relative thereto. The corner welds attaching the shadow mask to the frame are located approximately at the centers of the straight and flat portions of the truncated corners.

DETAILED DESCRIPTION

Figure 1:
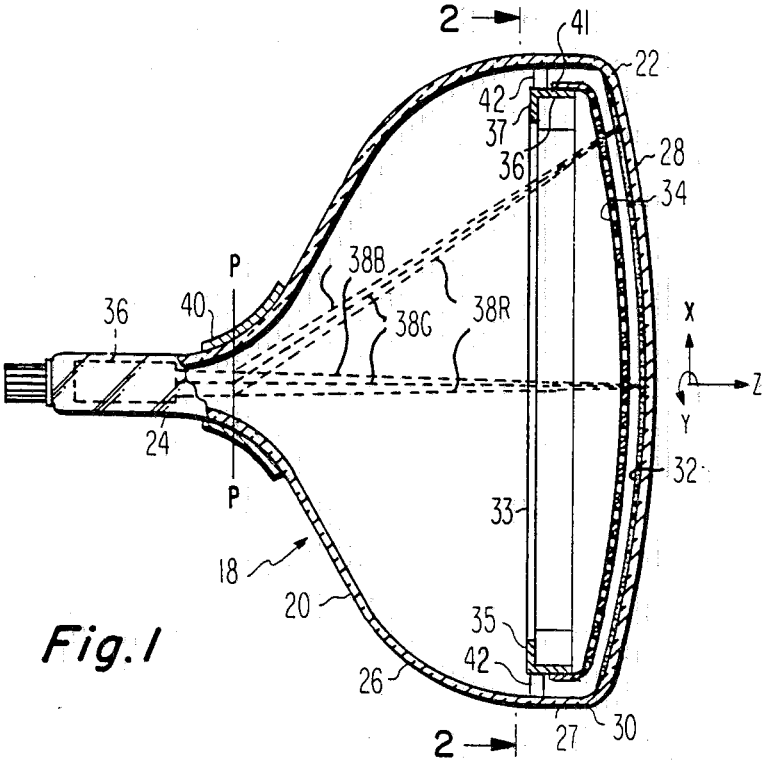
FIG. 1 is a plan view in axial section of an apertured mask cathode-ray tube.
Figure 2:
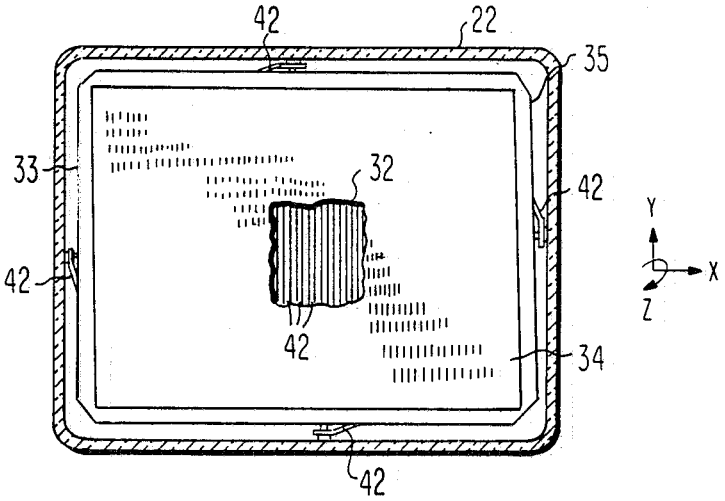
FIG. 2 is a back view of the faceplate and mask-frame assembly of the tube of FIG. 1.

FIGS. 1 and 2 illustrate a color picture tube 18 having an evacuated glass envelope 20 comprising a rectangular faceplate panel 22 and a tubular neck 24 joined by a funnel 26. The faceplate panel includes two orthogonal axes; a major axis X—X, parallel to its wider dimension (usually horizontal), and a minor axis Y—Y, parallel to its narrower dimension (usually vertical). The major and minor axes are perpendicular to the central longitudinal axis Z—Z of the tube which passes through the center of the neck 24 and the center of the panel 22. The panel 22 comprises a viewing faceplate 28 and a peripheral flange or sidewall 30 which is sealed to the funnel 26 by a frit material 27. A three-color cathodoluminescent line screen 32 is located on the inner surface of the faceplate 28. The screen 32 comprises an array of phosphor lines extending substantially parallel to a minor axis Y—Y of the tube. Portions of the screen 32 may be covered with a light absorbing material in a manner known in the art. A mask-frame assembly 33, comprising a novel apertured color selection electrode or shadow mask 34 attached to a novel L-shaped frame 35, is removably mounted within the panel 22 in predetermined spaced relationship to the screen 32 by four springs 42. The mask 34 includes a multiplicity of slit-shaped apertures which are aligned in substantially parallel columns with web portions separating the slits within each column. The L-shaped frame 35 includes two flanges 36 and 37. The first flange 36 extends toward the screen 32 and approximately parallels the central longitudinal axis Z—Z. The second flange 37 extends inward toward and approximately perpendicular to the central longitudinal axis Z—Z. The mask 34 also includes a peripheral skirt 41 which is telescoped relative to the frame flange 21.

An inline electron gun 36 (illustrated schematically) is mounted within the neck 24 to generate and direct three electron beams 38B, 38R and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to perpendicular magnetic fields that cause the beams to scan in a rectangular raster over the screen 32.

Figure 3:
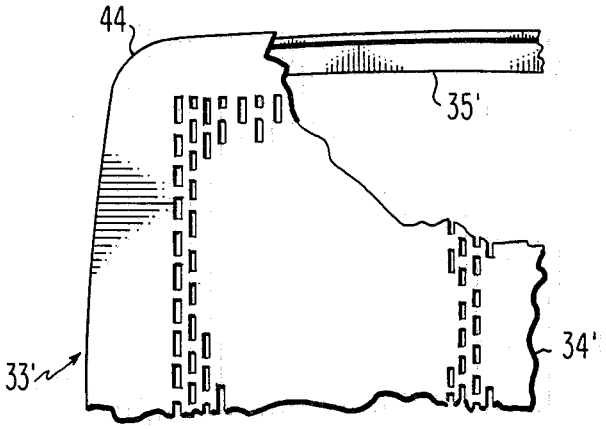
PRIOR ART Fig.3
FIG. 3 is a partially broken-away plan view of a corner portion of a prior art mask-frame assembly.

FIG. 3 shows a corner portion of one type of prior art mask-frame assembly 33' including an apertured shadow mask 34' attached to a peripheral frame 35'. The corners of the mask 34' and frame 35' are rounded, and the mask 34' is welded to the frame 35' at a point 44 on the corner. Because of the bends in the mask 34' at the corners, the mask 34' is relatively rigid in the corners with very little flexibility. The embodiments of the present invention provide greater corner flexibility than this type of prior art structure and do not require cutouts and tabs, as needed by some other prior art structures.

Figure 4:
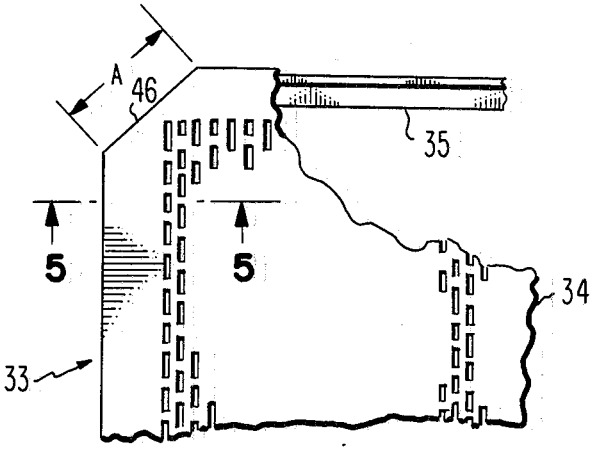
FIG. 4 is a partially broken-away plan view of a corner portion of the mask-frame assembly of the tube of FIG. 1.
Figure 5:
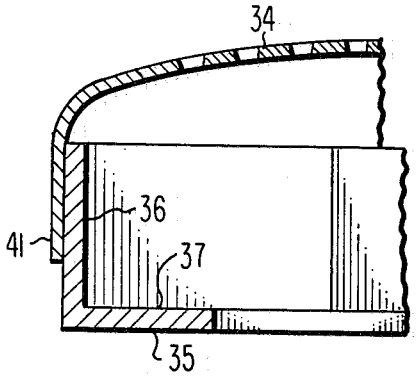
FIG. 5 is a sectional view of the corner portion of the mask-frame assembly taken at line 5—5 of FIG. 4.
Figure 6:
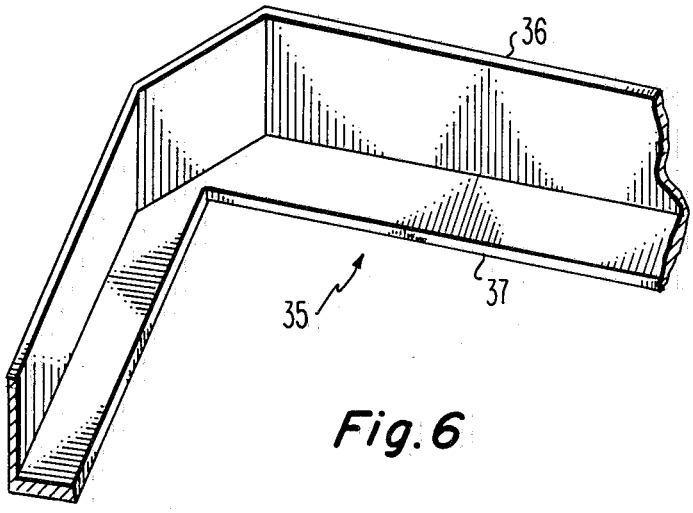
FIG. 6 is a perspective view of a corner of the frame of the tube of FIG. 1.

FIGS. 4, 5 and 6 show the details of the novel mask-frame assembly 33 in the tube 18. The major noticeable differences of the novel mask-frame assembly 33 from the prior art assembly 33' of FIG. 3 are that the sides are straighter, and the corners are truncated. The first flange 36 of the frame 33 at the frame corner is straight, flat and acutely angled with respect to both the major axis X—X and the minor axis Y—Y. A peripheral portion of the shadow mask 34 conforms to the shape of the first flange 36 and is telescoped thereon. The skirt 41 of each angled corner portion of the mask 34 is welded to the truncated corner of the frame 35 at a point 46 located approximately at the center of the straight and flat frame corner. The weld also is located near the distal end of the skirt 41 to permit maximum radial flexibility.

In the prior art mask-frame assembly 33' of FIG. 3, the location of the weld 44 peripherally around the corner and relative to the distal edge of the mask is somewhat critical. Small variations from a predetermined design location can have large effects on mask expansion and doming. However, in the novel mask-frame assembly 33, the location of the weld 46 at the truncated corner is not as critical, thereby reducing tube-to-tube variations that may be caused by variations in mask-to-frame welding. This advantage results from the greater flexibility of the straight flat portion of the mask skirt 41 at the truncated corners. Such flexibility also results in less resistance to mask expansion and, thus, less mask doming.

The mask skirt flexibility at the truncated corners can be tailored by varying the length A of the straight flat portions of the corners. A shorter length A will result in less flexibility, and a longer length A will result in greater flexibility.

Figure 7:
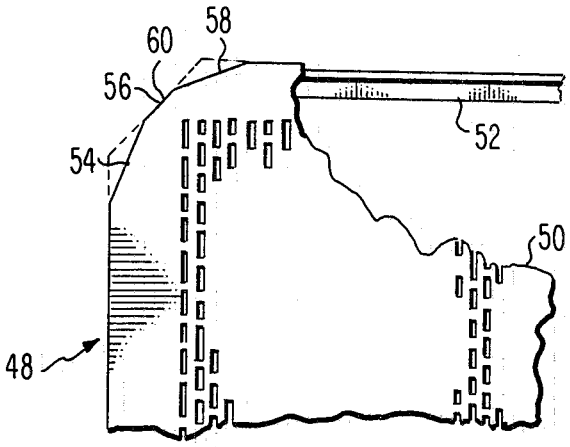
FIG. 7 is a partially broken-away plan view of a corner portion of another mask-frame assembly.

In some applications, the truncation of the mask-frame assembly corners may result in undesirable microphonics of the mask because of the flexibility of the corners. Such microphonics can be controlled by a modification of the truncated corners of a mask-frame assembly 48, as shown in FIG. 7. The mask-frame assembly 48 includes a shadow mask 50 attached to an L-shaped peripheral frame 52. Each corner of the mask-frame assembly 48 includes three integrally consecutive straight flat segments 54, 56 and 58, all of which are acutely angled with respect to the major and minor axes. The mask 50 is welded to the frame 52 at the approximate center point 60 of the center segment 56. Specific microphonics problems can be controlled by appropriately tailoring the lengths or angles of the segments.

Figure 8:
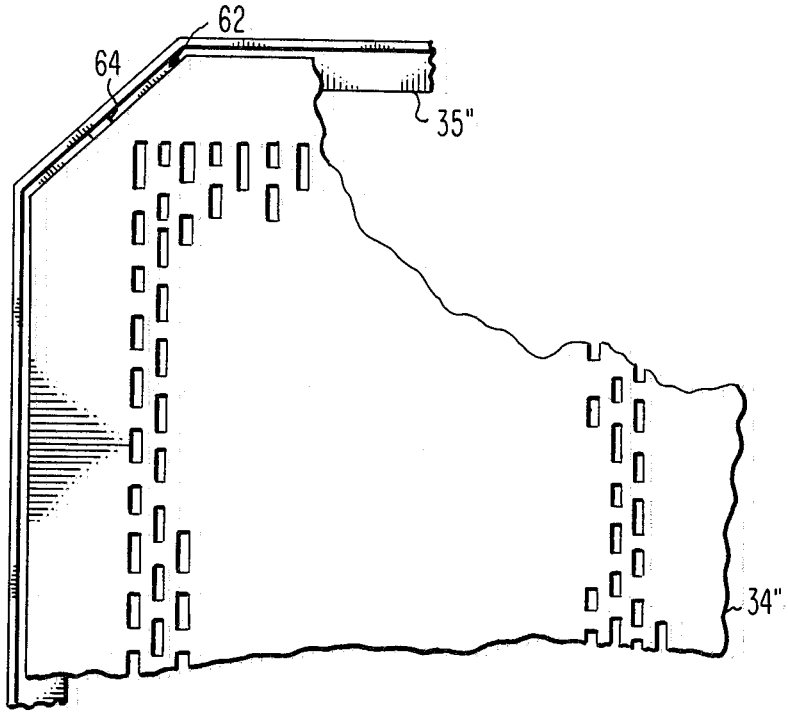
FIG. 8 is a partially broken-away plan view of a corner portion of another mask-frame assembly.

Although the foregoing mask-frame assembly 33 has been shown with the mask telescoped over the frame, the truncated corners also may be used in a mask-frame assembly 33'', where a mask 34'' is telescoped within the frame 35'', such as shown in FIG. 8. In the assembly 33'', the mask 34'' is dimensioned slightly smaller than the frame 35'' so that a gap 62 exists between the mask 34'' and frame 35''. The purpose of the gap 62 is to permit room for mask expansion. Attachment of the mask 34'' to the frame 35'' is made at flutes or embosses 64 in the mask skirt that extend outwardly to contact the frame 35''. Alternatively, the frame could have tabs or embosses that extend inwardly to contact the mask.

What is claimed is:

1. In a color picture tube including an evacuated envelope having a rectangular faceplate panel with major and minor axes and wherein a central longitudinal axis of said tube passes through the center of said faceplate perpendicular to the major and minor axes, said faceplate panel including a shadow mask welded at various points including its corners to a peripheral frame mounted therein, said frame having a flange approximately paralleling the central longitudinal axis, and said shadow mask having a peripheral skirt approximately paralleling the central longitudinal axis, the improvement comprising said shadow mask having truncated corners wherein the skirt portions at the corners are straight, flat and acutely angled with respect to both the major axis and the minor axis and are welded to said frame at approximately the centers of the straight and flat skirt portions.

2. The tube as defined in claim 1, wherein said straight and flat skirt portions are interconnected to a remaining portion of the skirt by other skirt portions that are acutely angled with respect to the major and minor axes.

3. In a color picture tube including an evacuated envelope having a rectangular faceplate panel with major and minor axes and wherein a central longitudinal axis of said tube passes through the center of said faceplate perpendicular to the major and minor axes, said faceplate panel including a shadow mask welded at various points including its corners to a peripheral frame mounted therein, said frame having a flange approximately paralleling the central longitudinal axis, the improvement comprising said frame having truncated corners wherein said flange at each of the frame corners has at least one portion that is straight, flat and acutely angled with respect to both the major axis and minor axis, and a peripheral portion of said shadow mask conforms to the shape of said flange and is telescoped relative thereto and wherein the corner welds attaching said shadow mask to said frame are located approximately at the centers of the at least one straight and flat portions of the truncated corners.

* * * * *